US006101921A

United States Patent [19]

Granberg et al.

[11] Patent Number: 6,101,921

[45] Date of Patent: Aug. 15, 2000

[54] FLUID PRESSURE CYLINDER

[75] Inventors: Rune Granberg, Aelvsjoe; Kenneth Johansson, Johanneshov, both of Sweden

[73] Assignee: AB Rexroth Meeman, Stockholm, Sweden

[21] Appl. No.: 09/182,743

[22] Filed: Oct. 28, 1998

[30] Foreign Application Priority Data

Oct. 31, 1997 [SE] Sweden ..... 9703997

[51] Int. Cl.[7] ..... F01B 29/00

[52] U.S. Cl. ..... 92/88; 92/128; 92/143

[58] Field of Search ..... 92/88, 137, 143, 92/177, 128

[56] References Cited

U.S. PATENT DOCUMENTS 4,519,297 5/1985 Lipinksi ..... 92/88
4,664,019 5/1987 Lipinski et al. ..... 92/88
4,724,744 2/1988 Rosengren ..... 92/88
4,856,415 8/1989 Noda ..... 92/88

*Primary Examiner*—John E. Ryznic
*Attorney, Agent, or Firm*—Townsend and Townsend and Crew LLP

[57] ABSTRACT

A fluid pressure cylinder of the kind including a cylinder tube (23) with a slot and being shielded and sealed by an outer (11) and an inner (10) sealing band and with a cylinder bore (23') and a piston (2,5) which is movably arranged inside the tube and a transfer means (3) for transferring the piston movement through the slot to means (4) at the outside of the cylinder tube, wherein the piston comprises a seat (7) for a piston sealing member (6). The piston comprises a central body (2) and two piston end units (5) surrounding the respective end of the piston body and lying (17) against the cylinder bore, wherein each piston end unit (5) is fitted with play (s) onto the body (2) in order to allow a relative movement between these elements in directions essentially perpendicular to the cylinder axis.

11 Claims, 3 Drawing Sheets

FLUID PRESSURE CYLINDER

This invention concerns a fluid pressure cylinder according to the preamble of claim 1.

BACKGROUND

U.S. Pat. No. 4,664,019 (Lipinski & al.) discloses a fluid pressure cylinder on this kind, wherein between the transfer element and the shuttle superstructure is placed a bearing means allowing limited relative movement between these members in order to avoid problems concerning mainly defects with respect to lack of parallelism between the cylinder bore and the outside guide. This known device is expensive and complicated to produce, since it presupposes manufacture and assembly of several parts and precision machining, particularly on the bearing surfaces of the bearing means. All together this results in an expensive fluid pressure cylinder.

It is an aim of this invention to improve the prior art by providing a solution to the parallelism problem which does not suffer from the above drawbacks and thus may be manufactured at low cost, is reliable and further is suitable for manufacture in large series.

This aim is obtained in a fluid pressure cylinder as above by the features of the characterized portion of claim 1.

SUMMARY OF THE INVENTION

By thus each piston end unit surrounding an end of the piston body and being mounted so as to allow a relative movement between these elements, several advantages are achieved. Firstly, the piston body may be produced essentially more rationally, since there will be no need of separate bearing means between the transfer element and the shuttle super-structure. Not least the assembly work will be simplified most essentially, resulting in a fluid pressure cylinder which may be produced at an essentially lower cost than before. At the same time a solution is achieved which is advantageous from the aspects of reliability and strength. Said play may be simply obtained by the piston end unit being produced with inside dimensions which in the radial direction somewhat exceed the part of the piston body which is intended to be surrounded.

Claim 2 defines a construction of the piston sealing element seat which is preferred from an aspect of manufacture.

The aspect of the invention according to claim 3, wherein the band guiding means are integral with the piston end units result in further advantages with respect to manufacture. According to the prior art such elements are comprised of separate parts which are separately mounted on the piston and on the transfer means, respectively. According to this aspect the number of parts included in the device may thus be reduced and the assembly work simplified. Claims 4 and 5 define preferred constructions of the elements in question.

With the feature of claim 6 further advantages of the device will result in the case where the cushioning projection is arranged on the piston, which further gives the advantages that drawing of channels inside the cylinder end walls may be made simpler and with less flow restrictions therein.

The feature according to claim 8 result in preferred simplification of the piston construction which is essentially accentuated by the feature of claim 9, whereby production of the piston unit may simplified so that the entire piston unit including at least the piston body, the transfer means and the shuttle superstructure is manufactured as one piece of a profile body of extruded, preferably, aluminium or an aluminium alloy. Machining of the profile body is essentially limited to cutting and a few machining operations, i.a. in order to get access to passage channels for the sealing bands.

The feature of claim 10 guarantees further simplified assembly and at the same time safe fastening.

A play s which has been found suitable for normal cylinder sizes ranges between about s being 0.5–1.0 mm (claim 11).

The aspect according to the invention thus assures that possible oblique angle resulting from manufacturing tolerances may be absorbed by the play between the piston body and the piston end units. Normally it is hereby the question of minimal deviations which, however, in a completely rigid joint could cause locking or excessive wear. By this aspect of the invention the entire piston unit may be produced in one essentially rigid piece, for example according to the aspects of the claims 8 and 9, wherein the need of complicated coupling devices allowing movements between for example the transfer means and the shuttle superstructure is avoided.

The invention will now be described in greater detail by way of an embodiment and with reference to the annexed drawings, wherein:

DRAWINGS

FIG. 1 shows a section through a piston unit according to the invention with applied piston end units, FIG. 2 shows a piston end unit in a perspective view, FIG. 3 shows the piston end unit of FIG. 2 in an end view as seen in the direction of arrow III, and FIG. 4 shows a fluid pressure cylinder according to the invention in a section through the piston unit and the cylinder tube.

DETAILED DESCRIPTION OF THE INVENTION

Figure 1:
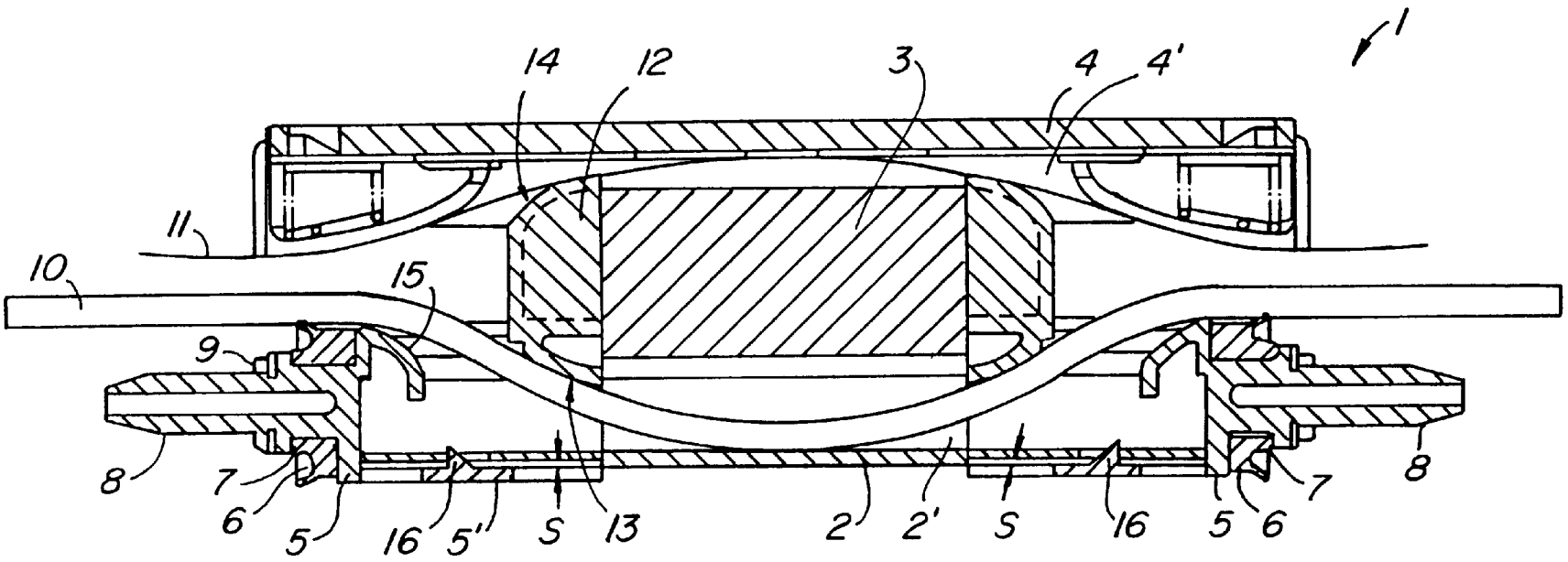

In FIG. 1, 1 indicates a piston unit including an essentially tubular piston body 2, a transfer means 3 for passage through the cylinder slot and a shuttle superstructure 4. Onto each axially most outward end area of the piston body there is fitted a piston end unit 5 having a partially sleeve-shaped portion 5' (is more clear on FIG. 2) for surrounding the respective piston body end in such a way that a play s will occur in essentially radial directions between the piston body 2 and the piston end unit 5. Further, in the axial direction of said portion 5' there extends a protruding portion having reduced dimensions in radial direction so as to form a seat 7 for a piston sealing member 6. Most outwardly on the unit 5, a cushioning projection 8 is arranged for cushioning co-operation with a corresponding cavity in the cylinder end wall, and side-ways, with respect to the cushioning projection 8, buffer devices 8 for softening the strike against the cylinder end wall.

10 indicates an inner sealing band which is not shown in detail here and 11 an outer sealing band which both may be of a conventional kind. The sealing bands 10 and 11 run in a channel 2' in the piston body and a channel 4' in the shuttle super-structure, respectively. In the shown embodiment, the piston end unit 5 carries a band guiding element 12, which on the one hand is provided with an inner guiding surface 13 for co-operation with the upper surface of the inner sealing band, on the other hand with an outer guiding surface 14 on a guiding tongue (shown in greater detail in FIG. 2) passing the cylinder slot and for co-operation with the upper sealing band 11. Further, the shuttle superstructure 4 comprises depression devices 20, which may be of a conventional kind for co-operation with the upper side of the outer sealing band 11.

FIG. 1 further shows a snap lock means 16 on each piston end unit, which means is comprised of a pin having an inclined entering surface tapering against the direction of fitting onto the piston body 2, and which means is arranged so as to cooperate with a corresponding recess made in a surface on the piston body, at the same time as it is guaranteed by the design of the recess that relative movement between the piston body 2 and the piston end units 5 is not prevented in directions essentially perpendicular to the cylinder axis.

Figure 2:
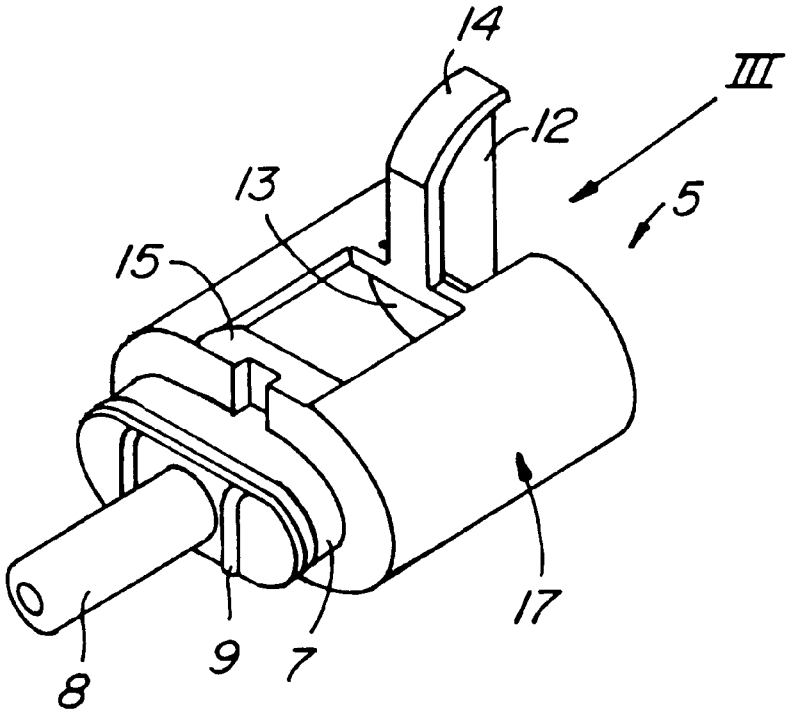

The perspective view in FIG. 2 shows the piston end unit 5 which in this case is adapted for a piston having an oblong section, with its integral functions, namely the guide surface 17 which is adapted to guide the piston end unit inside the cylinder tube, the axially protruding sealing member seat portion 7, the axially most outwardly arranged cushioning projection 8 and the sideways placed buffer devices 9 which may be separate elements, insertable into cavities in the piston end unit or integral parts, possibly of another, preferably softer, material. Further, the guiding tongue is shown forming the outer portion of the band guiding element 12 and the guiding surface 14 thereon, the inner guiding surface 13 and the lower guiding surface 15. The construction of the piston end unit assures guidance of the integral functions inside the cylinder bore.

Figure 3:
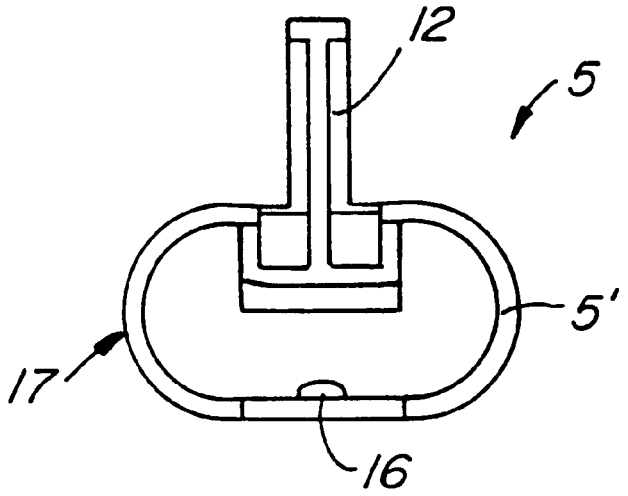

The end view of FIG. 3 shows further more clearly the sleeve-shape 5' with the guide surface 17. It should be noted that the hollow construction which is most apparent in FIG. 3, results in that a piston body being located inside the sleeve portion may be fitted with play against the inner surface. The snap lock means 16 is shown as an inwardly located inclined pin centrally on the inner surface.

Figure 4:
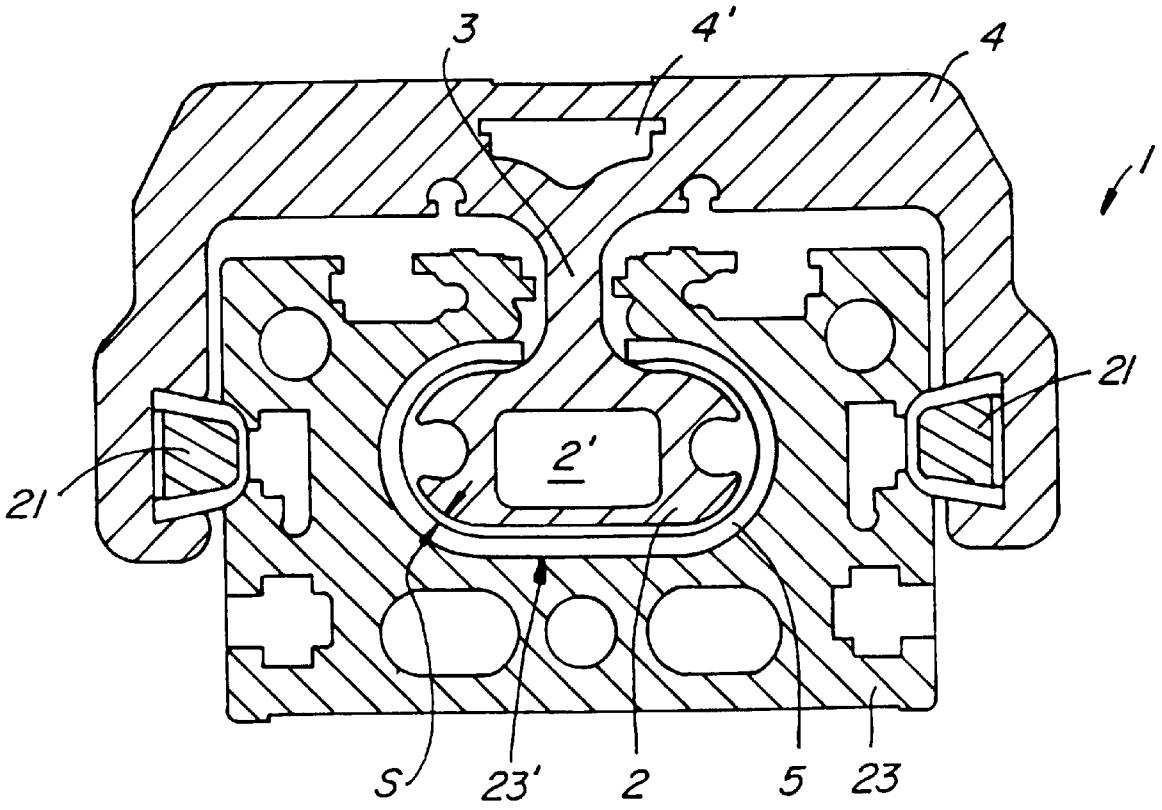

In FIG. 4, the piston body 2 is shown with the sealing band channel 2', the transfer means 3 which passes through the slot 22 and the shuttle superstructure 4 with the channel 4' for the outer sealing band 11. The shuttle superstructure 4 is provided with linear guiding means, at 21, of a conventional kind for sliding guidance. Other external linear guides, such as ball rail guides, may also come into question.

The piston body is thus produced with dimensions of its end portions which are reduced in radial directions with respect to the inner dimensions of the sleeve portion 5' of the piston end unit 5 (see FIG. 3). The play, which is indicated with s in the Figure therefore results in that certain defects with respect to parallelism of the guide 21 for the shuttle superstructure 4 with respect to the cylinder bore 23' may be tolerated, since the deviation will be absorbed by the play s in spite the piston body 2, the transfer means 3 and the shuttle super-structure 4 forming an integral rigid unit. The defects in question are mainly due to manufacturing tolerances, which have occurred mainly at the manufacture of the cylinder tube, such as for example when extruding the parts making it up, or when applying a separate outside linear guide. In the shown example, however, the piston unit as well as also the cylinder tube 23 with integral linear guide are produced extruded in aluminium or an aluminium alloy. A certain oblique angle due to uneven load may also be absorbed by said play s. By forming the joint between the piston body and the piston end units 5 this way, the need of a coupling allowing a relative movement between the transfer means and the shuttle superstructure which is located outside the slot may be avoided. Such an arrangement would otherwise be necessary in order to avoid locking effects and/or wear. The solution according to the invention thus gives the possibility of manufacturing a piston unit including a piston body, a transfer means and a shuttle superstructure as one rigidly connected unit or an integral part, preferably as an extruded profile. This gives essentially reduced costs for production as well as for the finished product.

The invention may be modified within the scope of the annexed claims, whereby the protection also includes cylinders having piston end units not including piston seals, band guiding means or cushioning projection, also if it is highly preferred that such elements are integrated into the unit. The fastening means for the piston end units with respect to the body may be shaped differently than what is shown, for example as snap lock means located otherwise, with grooves and ridges engaging each other etc. or with separate locking pins. The fastening does not need to be more complicated than so because normally the piston end units are not affected by forces in a releasing direction. The pressing forces between pressure fluid and piston are transferred through the contact surface between the piston end unit and the piston body.

The piston unit may be shaped differently than what is shown, as an example the body may have reversed U-shape instead of tubular shape.

Materials suitable for the piston units are synthetic materials and the production method may be of a conventional kind for plastic materials.

It should finally be stated that play s outside the defined preferred interval 0.5–1.0 mm may occur for different types of cylinders, for example very big or very small.

What is claimed is:

1. Fluid pressure cylinder of the kind including a cylinder tube (23) with a slot and being shielded and sealed by an outer (11) and an inner (10) sealing band and with a cylinder bore (23') and a piston (2,5) which is movably arranged inside the tube and a transfer means (3) for transferring the piston movement through the slot to means (4) at the outside of the cylinder tube which are adapted to co-operate with an outer linear guide (21), wherein the piston at each piston end comprises on the one hand a seat (7) for a piston sealing member (6), on the other hand upper (14) and lower (13,15) guiding means for co-operation with said outer and inner sealing bands, characterized in that the piston comprises a central body (2) and two piston end units (5) surrounding the respective end of the piston body and lying (17) against the cylinder bore and comprising the piston sealing member (6) seat (7), wherein each piston end unit (5) is fitted with play (s) onto the body (2) in order to allow a relative movement between these elements and thereby the possibility of absorbing possible oblique angle between on the one hand elements (3,4) being connected to the piston and thereby the piston body (2), and on the other hand the cylinder bore (23').

2. Cylinder according to claim 1, characterized in that the piston sealing member (6) seat (7) is comprised of a groove on an axially extending portion having reduced dimensions in radial directions.

3. Cylinder according to claim 1, characterized that each piston end unit (5) comprises integral upper and lower guiding means (13,14,15) for the sealing bands (10,11).

4. Cylinder according to claim 3, characterized in that the guiding means for the inner band (10) is comprised of two rounded guiding surfaces (13,15), which are arranged to co-operate each with its own side of said band.

5. Cylinder according to claim 3, characterized in that the guiding means for the outer band (11) is comprised of a guiding surface (14) which is arranged on a guiding tongue (12) which in turn is arranged for passage of the cylinder slot.

6. Cylinder according to claim 1, characterized in that each piston end unit (5) comprises an integral cushioning protrusion (8).

7. Cylinder according to claim 1, characterized in that the piston end unit (5) is produced from a synthetic material.

8. Cylinder according to claim 1, characterized in that at least the piston body (2), the transfer means (3) and a shuttle superstructure (4) which is a fastening portion being displaceable on the outside of the cylinder, together form an integral piston unit.

9. Cylinder according to claim 8, characterized in that the piston unit is comprised of an extruded profile body.

10. Cylinder according to claim 1, characterized in that the piston end unit (5) is provided with a snap lock means (16), which is adapted to cooperate with snap lock recesses in the piston body (2), said elements being shaped for axial locking of the piston end unit thereto in such a way that a limited relative movement is allowed in directions essentially perpendicular to the cylinder axis.

11. Cylinder according to claim 1, characterized in that the play (s) amounts to between about 0.5–1.0 mm.

* * * * *